US006243884B1

(12) United States Patent
Simonson

(10) Patent No.: US 6,243,884 B1
(45) Date of Patent: Jun. 12, 2001

(54) TOILET SEAT ASSEMBLY HAVING AN UPRIGHT POSITION LOCK

(75) Inventor: Robert L. Simonson, costa Mesa, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/376,609

(22) Filed: Aug. 18, 1999

(51) Int. Cl.[7] ..... A47K 13/12; A47K 13/26

(52) U.S. Cl. ..... 4/236; 4/240; 4/242.1; 220/831

(58) Field of Search ..... 4/236, 240, 234, 4/242.1, 246.1; 220/831, 832

(56) References Cited

U.S. PATENT DOCUMENTS 1,243,815 * 10/1917 Collins ..... 4/240
3,020,564 * 2/1962 Chodacki et al. ..... 4/240 X
5,842,234 * 12/1998 Dixon ..... 4/235

* cited by examiner

*Primary Examiner*—Gregory L. Huson
*Assistant Examiner*—Kathleen J. Prunner
(74) *Attorney, Agent, or Firm*—Menotti J. Lombardi

(57) ABSTRACT

A toilet seat assembly comprising a seat for permitting a user to sit over a toilet bowl of a toilet apparatus and a hinge pivotally attaching the seat to the toilet apparatus so that the user can manually pivot the seat relative to the toilet bowl between a vertical-upright position and a horizontal-down position. The hinge has a lock which automatically engages when the seat is manually pivoted into the vertical-upright position to prevent the seat from inadvertently pivoting back to the horizontal-down position. The toilet seat assembly can be further provided with a lid for selectively covering the toilet seat. The hinge lock can be adapted to automatically engage when the lid is manually pivoted into the vertical-upright position to prevent the lid from inadvertently pivoting back to the horizontal-down position.

19 Claims, 5 Drawing Sheets

TOILET SEAT ASSEMBLY HAVING AN UPRIGHT POSITION LOCK

FIELD OF THE INVENTION

This invention relates to toilet seat assemblies, and in particular, to a toilet seat assembly having an upright position lock which prevents the toilet seat assembly from inadvertently pivoting from a vertical-upright position to a horizontal-down position.

BACKGROUND OF THE INVENTION

Many different types of toilet seat assemblies are available on the market today. In general, these toilet seat assemblies have a tendency to inadvertently drop from the upright position to the horizontal-down position. This is especially true of toilet seat assemblies of toilets found in mobile vehicles such as boats which are typically subjected to rolling and pitching movements.

Those users who patronize toilet facilities in a standing position find this tendency to be a real inconvenience. As such, the user must often hold the seat assembly in the upright position while using the facility. Some users will even lower the seat member of the assembly into the horizontal position and use the toilet facility in that manner. Such usage can create sanitary problems for subsequent users of the facility.

Accordingly, there is a need for a toilet seat assembly that is capable of remaining in the vertical-upright position even when the toilet facility to which it is mounted is located in a moving vehicle such as a boat or recreation vehicle.

SUMMARY OF THE INVENTION

A toilet seat assembly comprising a seat for permitting a user to sit over a toilet bowl of a toilet apparatus and a hinge pivotally attaching the seat to the toilet apparatus so that the user can manually pivot the seat relative to the toilet bowl between a vertical-upright position and a horizontal-down position. The hinge has a lock which automatically engages when the seat is manually pivoted into the vertical-upright position to prevent the seat from inadvertently pivoting back to the horizontal-down position.

The toilet seat assembly can be further provided with a lid for selectively covering the toilet seat. In such an embodiment, the hinge lock also can be adapted to prevent the lid from inadvertently pivoting from the vertical-upright position to the horizontal-down position.

BRIEF DESCRIPTION OF THE DRAWINGS

The advantages, nature, and various additional features of the invention will appear more fully upon consideration of the illustrative embodiment now to be described in detail in connection with accompanying drawings wherein.

It should be understood that the drawings are for purposes of illustrating the concepts of the invention and are not to scale.

DETAILED DESCRIPTION OF THE INVENTION

Figure 1:
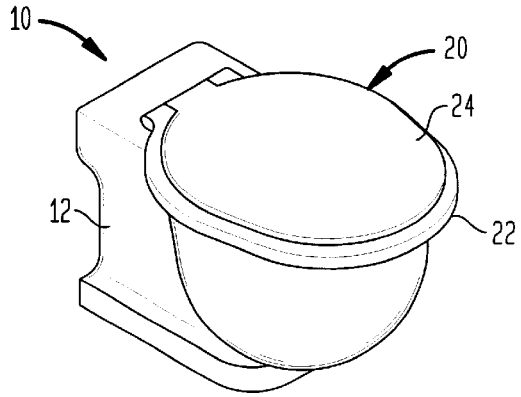
FIG. 1 is a perspective view of a toilet apparatus having a toilet seat assembly according to an embodiment of the invention.
Figure 2A:
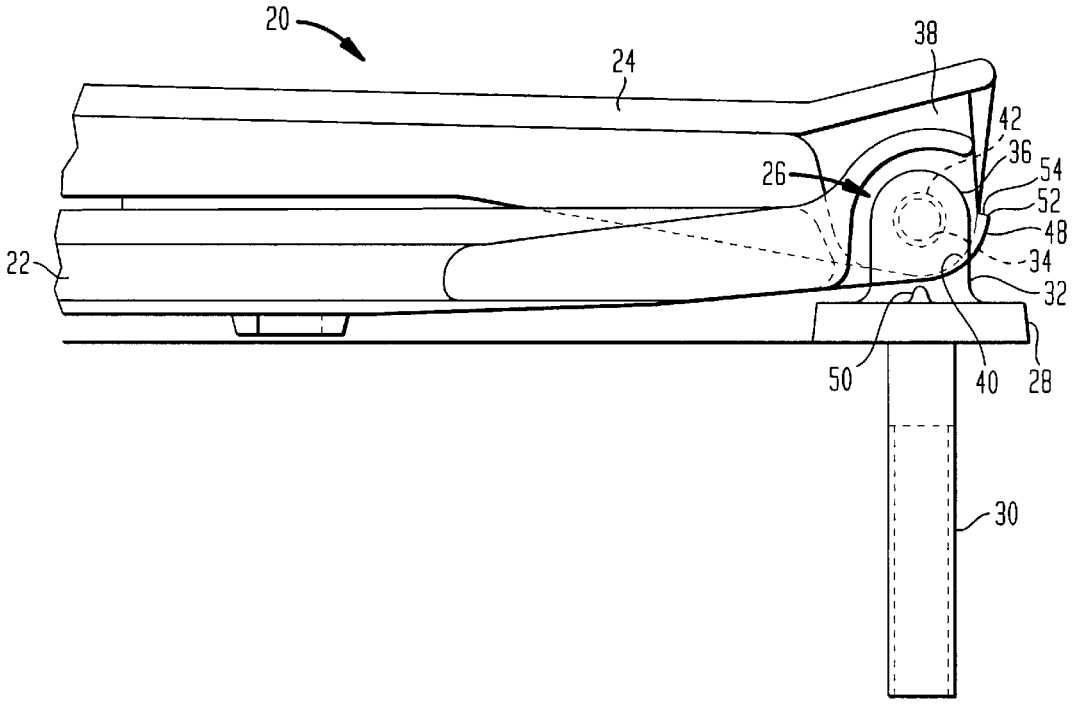
FIG. 2A is a side elevational view of the toilet seat assembly showing the seat elements of the lock in the horizontal-down position.
Figure 2B:
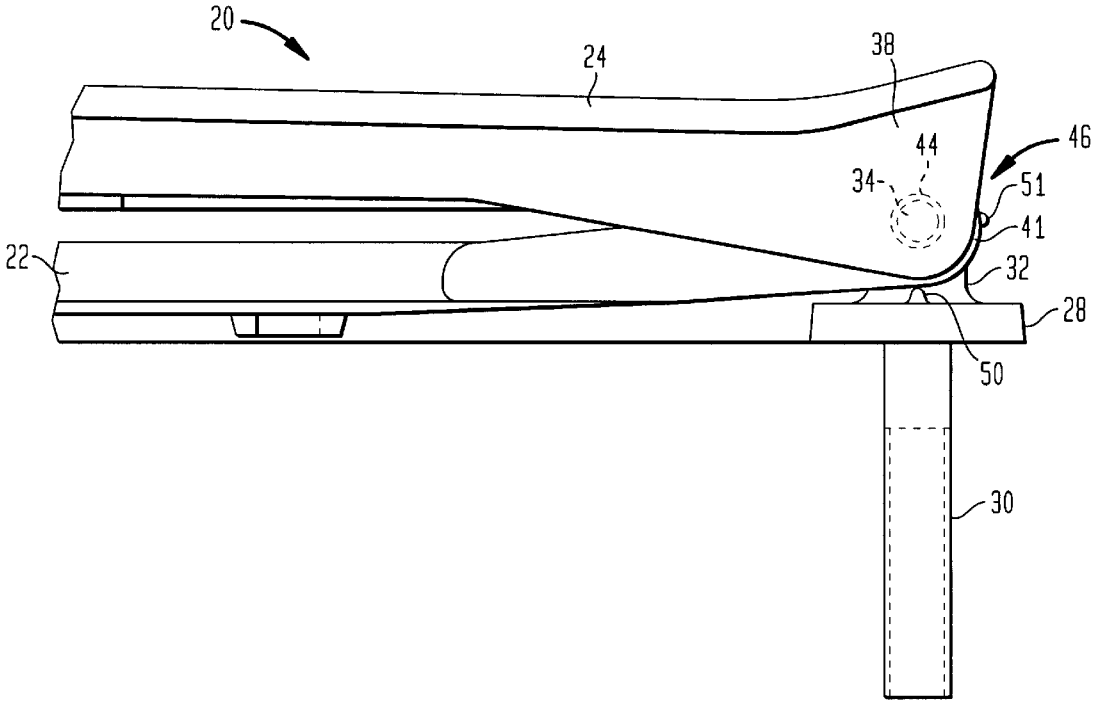
FIG. 2B is a side elevational view of the toilet seat assembly showing the lid elements of the lock in the horizontal-down position.

FIG. 1 shows a typical toilet apparatus 10 commonly used in marine and recreational vehicles. The toilet apparatus 10 has a toilet bowl 12, and uses a toilet seat assembly 20 according to an embodiment of the invention. The toilet seat assembly 20 of the invention can also be used with a toilet apparatus of the type which includes a water tank (not shown) mounted on the toilet bowl as commonly used in homes.

In any case, the toilet seat assembly 20 comprises a conventionally configured toilet seat 22 and associated cover or lid 24. As shown in FIGS. 2A, 2B, 3A, 3B, and 4, the toilet seat assembly 20 includes a hinge 26 that attaches the assembly 20 to the toilet bowl 12 of the toilet apparatus 10 and permits the toilet seat 22 and/or lid 24 to pivot relative to the toilet bowl 12 between a vertical-upright position and a horizontal-down position. The hinge 26 comprises a base 28 having a depending threaded stud 30 (can be unitary with the base 28 or separately inserted through an aperture in the base 28) that is received and bolted in an aperture (not shown) in the rear of the toilet bowl 12. The base 28 forms an upwardly extending boss 32 and a hinge pin 34 rigidly supported at one end by the boss 32. The hinge pin 34 is positioned and adapted to hingedly support the toilet seat 22 and the lid 24. The toilet seat 22 and lid 24 each have corresponding hinge pin receiving bosses 36, 38 formed thereon. The toilet seat hinge pin receiving boss 36 has an open ended bore hole 42. The lid hinge pin receiving boss 38 has a closed ended bore hole 44. The bore holes 42, 44 are axially aligned with each other to receive the hinge pin 34 which passes through the bore hole 42 of the toilet seat hinge pin receiving boss 36 and extends into the bore hole 44 of the lid hinge pin receiving boss 38.

In a preferred embodiment of the invention, the toilet seat 22 and lid 24 of the assembly 20 are prevented from inadvertently dropping from the vertical-upright position by providing the hinge 26 with a lock 46 that automatically activates when the toilet seat 22 and/or lid 24 are pivoted into the vertical-upright position to secure this position of the seat 22 and/or lid 24, but which can be overcome by moderate hand pressure applied to the toilet seat 22 and/or lid 24 when lowered to the horizontal-down position.

The lock 46 can comprise a detent mechanism having a cam element 48 unitarily formed on a peripheral surface portion 40 of the toilet seat hinge pin receiving boss 36, a raised elongated bead 51 unitarily formed on a peripheral surface portion 41 of the lid hinge pin receiving boss 38, and a raised elongated bead 50 unitarily formed on the top surface of the base 28. The cam element 48 has an abutment surface 52 at one end thereof that defines a concavity 54.

Figure 3A:
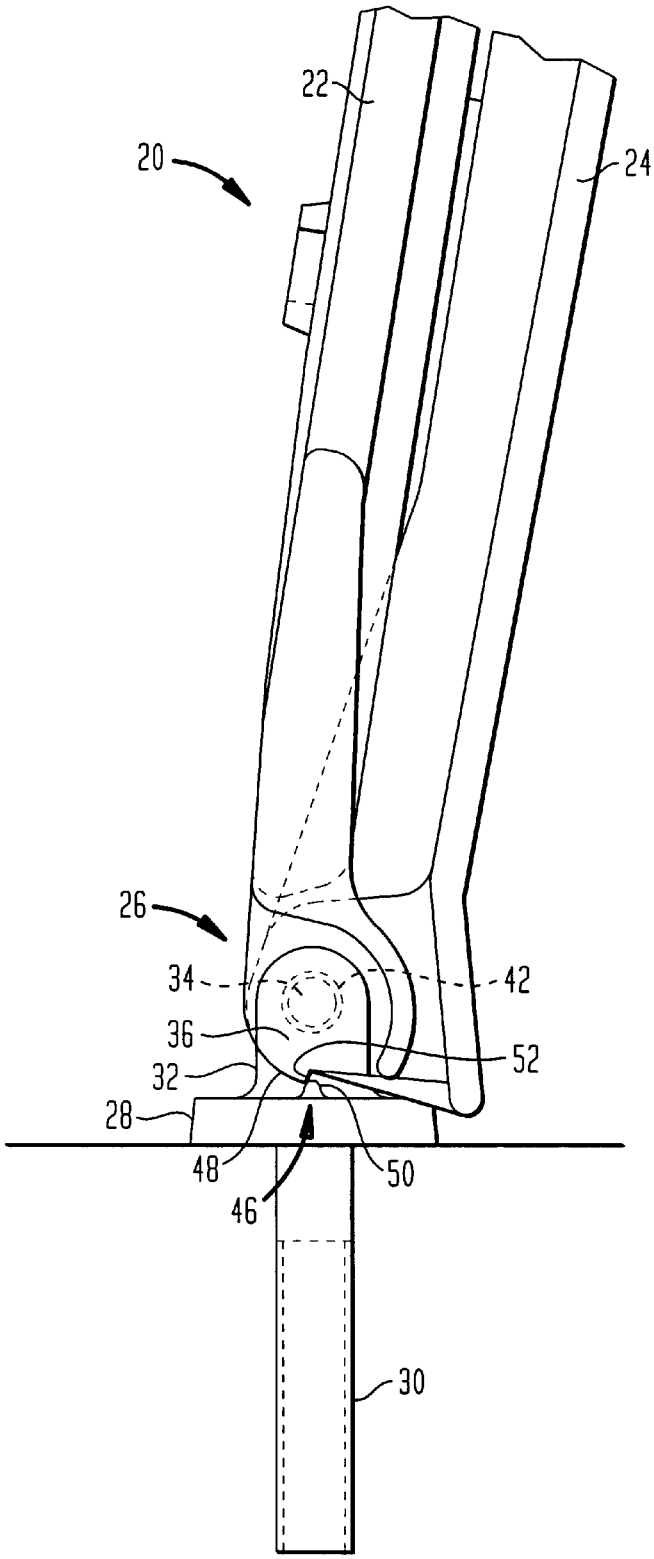
FIG. 3A is a side elevational view of the toilet seat assembly showing the seat elements of the lock in the vertical-upright position.

The force used in manually raising the toilet seat 22 into the vertical-upright position causes the cam element 48 to engage the raised bead 50 of the hinge base 28 and ride over it. As shown in FIG. 3A, as the seat 22 enters the fully raised vertical-upright position (slightly beyond vertical), the cam element 48 snaps over the bead 50 so that the concavity 54 formed by the abutment surface 52 abuts against the hinge base bead 50. The cam element concavity 54 and the hinge base bead 50 cooperate to prevent the toilet seat 22 from inadvertently pivoting to the horizontal down position under its own weight or under the moderate inertial pressures of the rolling and pitching motions of a vehicle such as a boat.

Figure 3B:
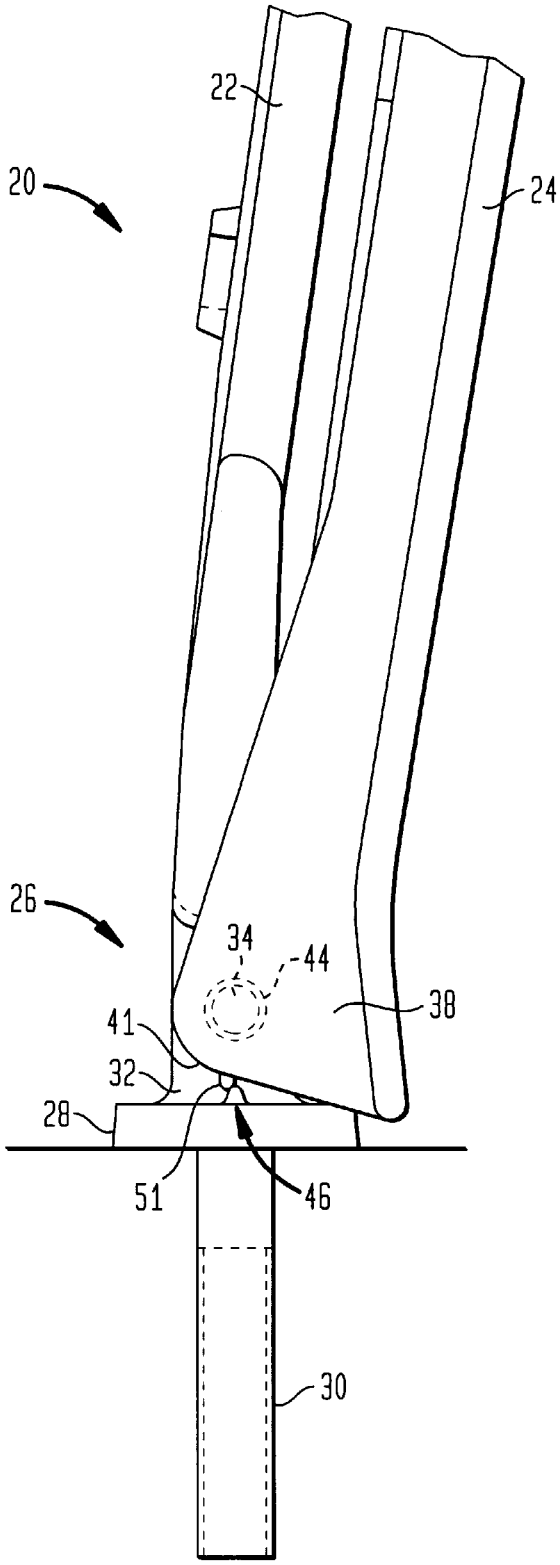
FIG. 3B is a side elevational view of the toilet seat assembly showing the lid elements of the lock in the vertical-upright position showing the lid elements of the lock.
Figure 4:
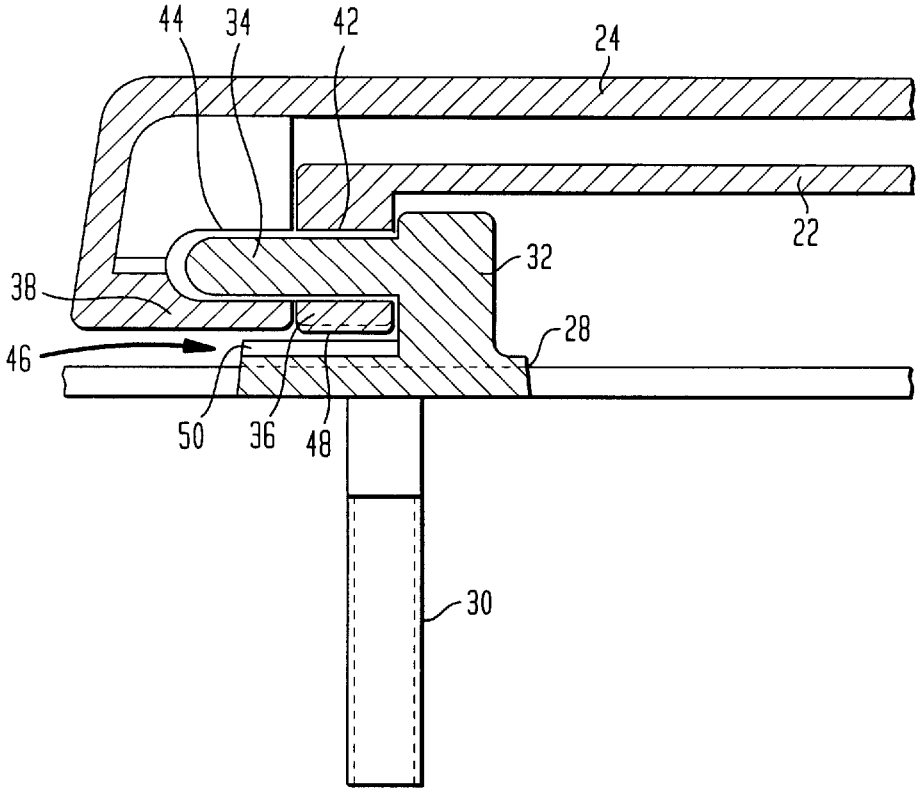
FIG. 4 is a rear sectional view of the toilet seat assembly in the horizontal-down position.

The hinge lock 46 operates on the lid 24 in a manner similar to the way it operates on the toilet seat 22. The force of manually raising the lid 24 into the vertical-upright position causes the lid bead 51 to engage the raised bead 50 of the hinge base 28 and snap over it as shown in FIG. 3B. Once past the hinge base bead 50, the lid bead 51 abuts against it to hold the lid 24 in the vertical-upright position even when subjected to moderate inertial pressures of the rolling and pitching motions.

When it is desired to pivotally lower the toilet seat 22 and/or lid 24, to the horizontal-down position, moderate hand pressure on the seat 22 and/or lid 24 will overcome the resistance to rotation created by the coaction of the cam element 48 and/or lid bead 51 with the hinge base bead 50 and permit the seat 22 and/or lid 24 to be lowered normally.

The toilet seat assembly 20 is typically molded from plastic using conventional plastic molding techniques. However, any other suitable material and fabrication technique can be used for making the toilet seat assembly 20 if desired.

Figure 5:
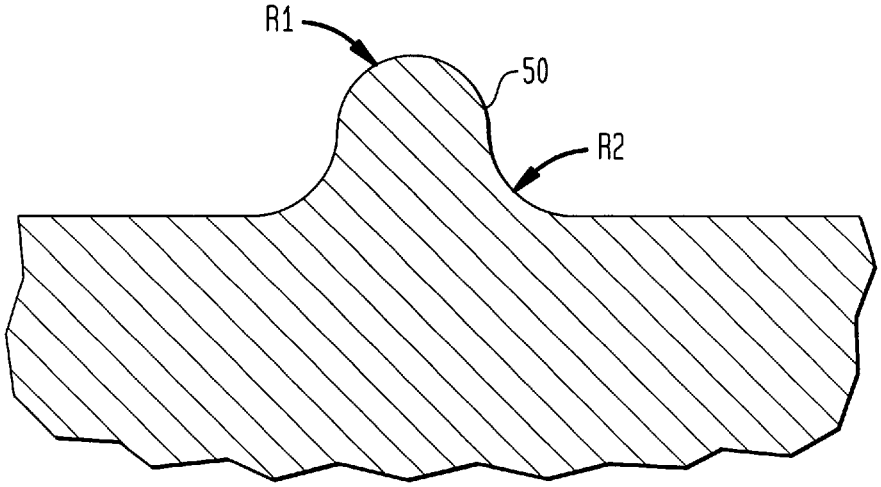
FIG. 5 is a enlarged sectional view of the bead.

FIG. 5 is an enlarged view of the base bead 50. The base bead 50 and hinge pin boss bead 51 of the lid 24 are each typically constricted to have a height of about 0.079 inches, a tip radius R1 of about 0.039 inches and a base radius R2 of about 0.039 inches. This ensures that the toilet seat 22 and/or lid 24 of the assembly can be repeatedly raised and lowered without noticeable wear on the cam abutment surface 52, the lid bead 51, or hinge base bead 50 while providing a locking action that remains relatively constant throughout the expected life of the toilet seat assembly 20. It should be understood, that the dimension and shape of the beads 50, 51 and the cam element 48 can be varied according to the weight and construction of the toilet seat 22 and lid 24.

Although the cam element 48 is preferred on the more frequently raised and lowered toilet seat 22 because it provides smoother and more progressive detent action, in another embodiment of the invention, the cam element 48 of the seat hinge pin receiving boss 36 can be replaced with a bead similar to that used on the lid hinge pin receiving boss 38. In still a further embodiment of the invention, the bead 51 of the lid hinge pin receiving boss 38 can be omitted.

While the foregoing invention has been described with reference to the above embodiments, various modifications and changes can be made without departing from the spirit of the invention. Accordingly, all such modifications and changes are considered to be within the scope of the appended claims.

What is claimed is:

1. A toilet seat assembly comprising:

a seat for permitting a user to sit over a toilet bowl of a toilet apparatus; and a hinge for pivotally attaching the seat to the toilet apparatus so that the user can manually pivot the seat relative to the toilet bowl between a vertical-upright position and a horizontal-down position, the hinge having a base for attachment to the toilet bowl and a lock which automatically engages when the seat is manually pivoted into the vertical-upright position to prevent the seat from inadvertently pivoting back to the horizontal-down position, the lock including a cam element and a bead which coacts with the cam element to form a detent mechanism, the bead disposed on a horizontal upper surface of the base.

2. The toilet seat assembly according to claim 1, wherein the hinge further includes a hinge pin pivotally coupling the seat with the base.

3. The toilet seat assembly according to claim 2, wherein the base of the hinge includes a boss which rigidly supports one end of the hinge pin.

4. The toilet seat assembly according to claim 3, wherein the seat includes a hinge pin receiving boss that pivotally receives the hinge pin.

5. The toilet seat assembly according to claim 4, wherein the cam element is formed on a peripheral section of the seat hinge pin receiving boss, the bead abutting against an abutment surface defined by the cam element when the seat is locked in the vertical-upright position.

6. A toilet seat assembly comprising:

a seat for permitting a user to sit over a toilet bowl of a toilet apparatus;

a lid for selectively covering the toilet seat; and a hinge for pivotally attaching the seat and the lid to the toilet apparatus so that the user can manually pivot the lid, the seat or the lid and seat together relative to the toilet bowl between a vertical-upright position and a horizontal-down position, the hinge having a base for attachment to the toilet bowl and a lock which automatically engages when at least the seat is manually pivoted into the vertical-upright position to prevent the seat from inadvertently pivoting back to the horizontal-down position, the lock including a cam element and a bead which coacts with the cam element to form a detent mechanism, the bead disposed on a horizontal upper surface of the base.

7. The toilet seat assembly according to claim 6, wherein the hinge further includes a hinge pin pivotally coupling the seat and the lid with the base.

8. The toilet seat assembly according to claim 7, wherein the base of the hinge includes a boss which rigidly supports one end of the hinge pin.

9. The toilet seat assembly according to claim 8, wherein the seat includes a hinge pin receiving boss that pivotally receives the hinge pin.

10. The toilet seat assembly according to claim 9, wherein the cam element is formed on a peripheral section of the seat hinge pin receiving boss, the bead abutting against an abutment surface defined by the cam element when the seat is locked in the vertical-upright position.

11. The toilet seat assembly according to claim 10, wherein the lid includes a hinge pin receiving boss that pivotally receives the hinge pin.

12. The toilet seat assembly according to claim 11, wherein the lock further comprises a detent member formed on a peripheral section of the lid hinge pin receiving boss, the detent member of the lid hinge boss abutting against the bead of the base when the lid is locked in the vertical-upright position.

13. A toilet apparatus comprising:

a toilet bowl;

a seat for permitting a user to sit over the toilet bowl; and a hinge pivotally attaching the seat to the toilet bowl so that the user can manually pivot the seat relative to the toilet bowl between a vertical-upright position and a horizontal-down position, the hinge having a base for attachment to the toilet bowl and a lock which automatically engages when the seat is manually pivoted into the vertical-upright position to prevent the seat from inadvertently pivoting back to the horizontal-down position, the lock including a cam element and a bead which coacts with the cam element to form a detent mechanism, the bead disposed on a horizontal upper surface of the base.

14. The toilet apparatus according to claim 13, wherein the hinge further includes a hinge pin pivotally coupling the seat with the base.

15. The toilet apparatus according to claim 14, wherein the base of the hinge includes a boss which rigidly supports one end of the hinge pin.

16. The toilet apparatus according to claim 15, wherein the seat includes a hinge pin receiving boss that pivotally receives the hinge pin.

17. The toilet apparatus according to claim 16, wherein the cam element is formed on a peripheral section of the seat hinge pin receiving boss, the bead abutting against an abutment surface defined by the cam element when the seat is locked in the vertical-upright position.

18. The toilet apparatus according to claim 17, further comprising a lid for selectively covering the toilet seat, wherein the hinge pivotally attaches the lid to the toilet apparatus so that the user can manually pivot the lid or the lid and seat together relative to the toilet bowl between the vertical-upright position and the horizontal-down position.

19. The toilet apparatus according to claim 18, wherein the lid includes a hinge pin receiving boss that pivotally receives the hinge pin and the lock further comprises a detent member formed on a peripheral section of the lid hinge pin receiving boss, the detent member of the lid hinge boss abutting against the bead of the base when the lid is locked in the vertical-upright position.

* * * * *